US005696502A

United States Patent [19]

Busch et al.

[11] Patent Number: 5,696,502

[45] Date of Patent: Dec. 9, 1997

[54] METHOD OF SENSING TRAFFIC AND DETECTING TRAFFIC SITUATIONS ON ROADS, PREFERABLY FREEWAYS

[75] Inventors: Fritz Busch, Mering; Andrea Ghio; Johannes Konrad, both of München, all of Germany

[73] Assignee: Siemens Aktiengesellschaft, Munich, Germany

[21] Appl. No.: 704,728

[22] PCT Filed: Mar. 1, 1995

[86] PCT No.: PCT/DE95/00265

§ 371 Date: Sep. 12, 1996

§ 102(e) Date: Sep. 12, 1996

[87] PCT Pub. No.: WO95/25321

PCT Pub. Date: Sep. 21, 1995

[30] Foreign Application Priority Data

Mar. 14, 1994 [DE] Germany ..... 44 08 547.8

[51] Int. Cl.[6] ..... G08G 1/09

[52] U.S. Cl. ..... 340/905; 340/933; 340/934; 340/919; 364/436; 364/437

[58] Field of Search ..... 340/905, 933, 340/934, 936, 928, 910, 919; 364/436, 437, 438

[56] References Cited

U.S. PATENT DOCUMENTS

| | | | |
|---|---|---|---|
| 3,536,900 | 10/1970 | Iwamoto et al. | 364/437 |
| 4,750,129 | 6/1988 | Hengstmengel et al. | 364/436 |
| 5,357,436 | 10/1994 | Chiu | 364/436 |

FOREIGN PATENT DOCUMENTS 0 171 098 A1 12/1986 European Pat. Off. .

OTHER PUBLICATIONS

Second IEEE International Conference On Fuzzy Systems, Proceedings of IEEE 2nd International Fuzzy Systems Conference, San Francisco, CA., Mar. 28, 1993, to Apr. 1, 1993; Traffic Prediction Method by Fuzzy Logic, by T. Iokibe et al; pp. 673–678.

*Primary Examiner*—Jeffery Hofsass
*Assistant Examiner*—Timothy Edwards, Jr.
*Attorney, Agent, or Firm*—Hill, Steadman & Simpson

[57] ABSTRACT

A method of sensing traffic and detecting traffic situations on roads (AS), preferably freeways. With measuring points (measuring cross sections MQ1, MQ2, . . . ) set up for the purpose for vehicle detection using traffic sensors (VS) and with a traffic data processing arrangement (VDVE) for traffic control, at regular intervals traffic data (VD), such as vehicle speed (v), traffic intensity (Q) and traffic density (K), are determined and traffic parameters determined therefrom are formed in a traffic data processing system (VDA). Two adjacent measuring points. (MQi, MQ(i+1) form a measuring section (MA) of a given length (l). The following traffic parameters are formed from the traffic data (VD) of two such measuring points:

a) the speed density difference (vk–D), which is calculated from the local traffic data of average speed (v) and traffic density (K);

b) a trend factor (FT), which is formed continually from the ratio between the traffic intensities (Qi/Q(i+1)) of the first and second measuring points (MQi, MQ(i+1)), but determined during a given period (t) in the minute range;

c) the traffic intensity trend (QTi, QT(i+1)) of the respective measuring point (MQi, MQ(i+1)), the trend being derived on the basis of the function of the traffic intensity (Q) over the time (curve Q (t)) from the increase of the tangent to the curve. The probability of a critical traffic situation (WG) is derived therefrom in a fuzzy logic (FUB).

5 Claims, 2 Drawing Sheets

METHOD OF SENSING TRAFFIC AND DETECTING TRAFFIC SITUATIONS ON ROADS, PREFERABLY FREEWAYS

BACKGROUND OF THE INVENTION

The invention relates to a method of sensing traffic and detecting traffic situations on roads, the roads having measuring points and measuring cross sections.

The constantly increasing volume of traffic on the roads, in particular freeways, with the resulting reduction in safety and the difficulties in correspondingly expanding the overall road or freeway network have led in recent decades to considerations concerning the use of electronics for increasing the efficiency and safety of roads.

There are in the meantime various systems and various methods which, on the basis of traffic measurements, switch appropriate displays on the variable message signs. The control is point-specific, if it relates to a specific point of the traffic flow (for example roadworks or narrowing of roadways), section-specific (generally referred to by the term "line influencing"), if its relates to a section, or network-specific, if it undertakes the automatic diversion from a normal route to an alternate route (variable route guidance).

Existing line influencing systems are very complex and expensive and are therefore installed selectively on sections where there is particularly heavy traffic. At the same time they require very high expenditure with respect to data acquisition and evaluation and for information transmission by means of variable message signs. To maintain clear relationships between the traffic situation and the controlled display, the control logic is of a relatively simple construction. The processed local measured values, such as generally smoothed traffic intensity, smoothed speed and local traffic density, are compared with predefined threshold values in order to make a statement or to activate the variable message sign.

In the case of systems in operation with traffic sensing and control of the traffic by variable message signs, until now the control has been carried out by definitive Yes/No statements, based on decision logics. For example, if traffic is heavy it can be harmonized by displaying the same speed restriction on all lanes. If the driving speed is reduced, a jam can be detected and a warning given. If relatively great traffic disruption is detected, it can be counteracted by means of a uniform speed restriction. Weather-dependent ambient conditions, which are sensed by separate sensors, are likewise displayed for line influencing. An early and reliable detection of hazardous traffic conditions is not readily possible with the known systems, because the traffic data acquired do not provide clear information on the actual traffic situation.

European reference EP-A-0 171 098 discloses a method of sensing traffic and controlling traffic on roads which has at least two measuring points for vehicle detection with traffic sensors. In this method, traffic data in the form of vehicle speeds are determined, processed and assessed taking into account the traffic intensity. It involves considering the determined speed data of at least two measuring points spaced apart by a certain length and comparing them with predetermined speed values on the basis of logic decisions.

The article "Traffic Prediction Method by Fuzzy Logic", Second IEEE International Conference on Fuzzy Systems (Cat. No. 93CH3136-9), Proceedings of IEEE 2nd International Fuzzy Systems Conference, San Francisco, Calif., U.S.A., 28 Mar.–1 Apr. 1993, ISBN 0-7803-0614-7, 1993, New York, N.Y., U.S.A., IEEE, U.S.A., pages 673–678 Vol. 2, Iokibe T. et al., discloses a method in which only the traffic intensity is measured and this is assessed together with empirical traffic intensity values with the aid of fuzzy logic in order to obtain an estimate of the traffic to be expected.

SUMMARY OF THE INVENTION

The object of the invention is an early and reliable automatic detection of critical traffic situations, such as traffic disruptions caused by the forming of a jam or an accident, on roads in order to warn the road users of this situation in good time.

In general terms the present invention is a method for sensing traffic and detecting traffic situations on roads, preferably freeways. The words have measuring points, referred to as measuring cross sections, for vehicle detection using traffic sensors and a traffic data processing arrangement for traffic control. At regular intervals traffic data, such as vehicle speed, traffic intensity, this is the number of vehicles at a measuring cross section based on a unit of time, and traffic density, that is the number of vehicles based on a specific section of road, is determined at the measuring points. Traffic parameters are determined therefrom and are formed in a traffic data processing system. First and second adjacent measuring points form a measuring section of a given length of road.

The following traffic parameters are formed from the traffic data of the first and second adjacent measuring points.

A speed density difference is calculated according to the following relationship:

$$vk-D=\sqrt{\left(\frac{v_{fi}-v_i}{v_{fi}}\right)^2+\left(\frac{k_i}{k_{max\,i}}\right)^2}-\sqrt{\left(\frac{v_{fi+i}-v_{i+1}}{v_{fi+1}}\right)^2+\left(\frac{k_{i+1}}{k_{max\,i+1}}\right)^2}$$

where vfi, vf(i+1) are adjustable maximum values of vehicle speed at the first and second measuring points, respectively;

kmaxi, kmax (i+1) are adjustable maximum values of the traffic density at the first and second measuring points, respectively;

ki is the traffic density after the first measuring point;

k(i+1) is the traffic density before the second measuring points;

vi, v(i+1) are average speeds at the first and second measuring points, respectively; and vk–D is the speed density difference.

A trend factor is formed continually from the ratio between the traffic intensities of the first and second measuring points, but determined during a given period in the minute range. Traffic intensity trends of the respective first and second measuring points are derived on the basis of the function of the traffic intensity over the time from an increase of the tangent to the curve. These three traffic parameters are processed with fuzzy logic for the detection of a critical traffic situation in the measuring section. They are fed as probability variables to a downstream result assessment arrangement, in which control signals for variable message signs are formed in dependence on adjustable threshold values.

Advantageous developments of the present invention are as follows.

The traffic parameters of speed density difference and trend factor are dynamically calibrated in dependence on their past values. A calibration factor for the speed density difference and a calibration factor for the trend factor are formed from the traffic data. In a calibration arrangement, arranged between the traffic data processing system and the fuzzy processing, the current speed density difference is divided by the speed density difference calibration factor and the respective current trend factor is divided by the trend factor calibration factor.

For calibration of the speed density difference, the latter is assessed. The value of the calibration factor for the speed density difference is a threshold value for the speed density difference from which there is a high probability of a critical traffic situation.

For calibration of the trend factor, a characteristic value of the trend factor estimated to be "small" is defined such that it comprises the set of the values of the trend factor whose relative cumulative frequency lies below a threshold value. A frequency table is formed with a plurality of classes with defined ranges of values of the trend factor. The current trend factor is assigned to a class in order to determine the calibration factor from it.

A disruption is determined and displayed as a critical traffic situation. The trend factor and the traffic intensity trend of the first measuring point are used to detect bunching and to form a bunching probability variable (PWG), the relationship of which with the traffic intensity trend of the second measuring point is established in order to derive a disruption criterion. The trend factor and the speed density difference and also the disruption criterion are also used to detect a disruption and to form a disruption probability variable.

With the method according to the invention, traffic data are acquired on the roads by measuring points set up for the purpose, that is to say respective measuring cross sections with traffic sensors fitted for each lane, and are processed in a processing arrangement provided for the purpose for a traffic control means. Specific traffic parameters are derived in a traffic data processing arrangement from the regularly acquired traffic data: speed and traffic intensity. For this purpose, two adjacent measuring points form a measuring section, which is of a given length, for example 3 km. The following traffic parameters are formed from the traffic data from these measuring points:

A speed density difference (vk–D) according to the relationship described above. The speed density difference takes into account the speed and the traffic density of both measuring cross sections. As a second traffic parameter, a trend factor is formed, which is formed continually from the ratio between the traffic intensities of the first and second measuring points, but only the values during a given period, for example the last 30 minutes, are taken into account. As the third traffic parameter, the traffic intensity trend of the respective measuring point is formed as a measure of the dynamic situation development, ie. the development over time of the traffic intensity. In this case, the trend of the traffic intensity is derived from the function of the traffic intensity over time or from the increase of the tangent to this function curve. These three traffic parameters are processed in a fuzzy logic to detect critical traffic situations, in order to obtain as an output variable a statement on the probability of a critical traffic situation. This probability variable is assessed in dependence on a predeterminable threshold value in order to generate a display recommendation for the variable message signs.

The use of fuzzy logic for detecting the traffic situation on roads has a series of advantages. The evaluating of the input data is very simple. A plurality of inputs can be further combined. As a result, it is possible to use a plurality of inputs simultaneously for one measure, even if they are not particularly meaningful individually. This leads on average to a faster response time. In addition, more complicated logics for situation interpretation, which are possible only by the combination of many data items (traffic intensity, speed and local density at the cross section and at the preceding or subsequent measuring cross section, trend factors, possibly ambient data) can be managed better with fuzzy logic. By virtue of the flexible thought processes of fuzzy logic, instead of a rigid binary decision (jam or no jam at a cross section) it is possible to determine a smooth transition, which may be represented in the form of a probability (for example the probability of a jam at this cross section is 70%). This has the advantage that this result can be assessed with a correspondingly predeterminable threshold value such that a reliable display recommendation can be announced at an early time.

Apart from the vehicle speed, which is determined at both measuring points and is generally processed as a smoothed mean value (v) for the respective measuring point, the traffic intensity (Q), which is also referred to as volume of traffic, and the traffic density (K) are used as traffic data. The traffic intensity indicates the number of vehicles at a measuring cross section, based on a unit of time, for example one hour. The traffic density is a measure of the number of vehicles based on a specific section of road. Use is made of a so-called local traffic density, which relates the number of vehicles to the measuring cross section and takes into account the corresponding speed. The traffic density is the quotient of the traffic intensity and the average speed (K=Q/v).

The traffic parameter of speed density difference vk–D is calculated from the local traffic data on average speed and the traffic density of two adjacent measuring cross sections (measuring points) according to the formula described above. The first term of the speed density difference relates to the measuring cross section MQi, the second to the downstream measuring cross section MQ(i+1). In order to be able to compare the traffic variables of different measuring cross sections, they are respectively referred to the adjustable maximum values of the traffic variables of the cross sections (max. free speed and max. traffic density). If traffic conditions at the measuring cross section are undisturbed, ie. the speed is not low and the traffic density is not high, the corresponding term moves in the range of very low values. If unstable traffic conditions prevail at the measuring cross section, ie. the speed is low and the traffic density is high, the value of the term concerned increases. Conclusions as to the current traffic conditions can thus be drawn from the difference between the two terms.

The trend factor (FT) is used as an indicator of a disruption. It is used to monitor the flow of vehicles into and out of the measuring section (MA), which may be of a given length, for example 3 km, and is formed by the two measuring points (MQi and (MQi+1)). In the case of a critical traffic situation, more vehicles enter the measuring section than leave it, as a result the trend factor (FT) increases exponentially. The calculation of the trend factor is based on the generally unsmoothed volumes of traffic, ie. the traffic intensities at the two measuring sections. Consequently, a higher accuracy and a faster response are achieved. In order to reduce the influence of measuring errors, the trend factor is respectively calculated only on the basis of the last measuring intervals, which means a period of, for example, 30 minutes.

The third traffic parameter, the traffic intensity trend (QTi), serves for assessment of the dynamic situation development. The calculation is based on the generally unsmoothed acquired traffic data. The traffic intensity trend is likewise considered at the two measuring cross sections.

These three traffic parameters are the input data for the fuzzy logic. The latter establishes a relationship between the input variables, which originate from two adjacent measuring cross sections, by means of a knowledge base defined by rules and derives from this relationship the probability of a critical traffic situation, for example a disruption.

The input variables of the fuzzy logic are dependent on many influences, in particular on the distance between the measuring points, the geometry of the section of road, ie. incline or decline, ambient conditions such as wetness, snow, black ice, day or night, and possible further influences. The influences are thus not only of a steady state, but also of a dynamic type. Therefore, in a development of the method according to the invention, the traffic parameters are calibrated such that the fuzzy system can always assess the input variables (traffic parameters) in the same way irrespective of external influences. For this purpose, the variables are dynamically calibrated in dependence on their past values.

$$\text{Calibration factor } vk_Diff = \frac{vk_Diff_{mittel} + 2 \cdot \sqrt{\sigma_{vk_Diff}} + 0.35}{\text{normalized instance } PSG}$$

where $\alpha$=0.05 (adjustable)

PSG=positive very big

The current speed density difference is divided by this calibration factor. For the calibration of the trend factor, the characteristic value of the trend factor is sought and is estimated to be "small". This characteristic valve is defined such that it comprises the set of all the values of the trend factor whose relative cumulative frequency lies below a threshold value. For this purpose, a frequency table is introduced, the classes of which are defined according to the table. A class is a defined range of values of the trend factor, all the classes together describing the total range of values of the trend factor. For each measuring interval, the current trend factor is assigned to a class; the respective class is then incremented. For each interval, consequently, the measured value for which the relative cumulative frequency lies below the predetermined threshold value is determined.

The classification is broader for very small and large values; a finer classification is chosen for the important calibration range:

| Class | 0 | 1 | 2 | 3 | ... | 35 | 36 | 37 |
|---|---|---|---|---|---|---|---|---|
| Range of characteristic values | −1 . . . 0.15 | >0.15 | >0.225 | >0.275 | ... | >1.925 | >1.975 | >2.025 |
| $F_T$ Classification | | ≦0.225 | ≦0.275 | ≦0.325 | | ≦1.975 | ≦2.025 | ≦2.075 |

In order to minimize the expenditure for the calibration for identifying a critical traffic situation, the trend factor and the speed difference are automatically calibrated. For this purpose, a calibration factor for the speed density difference and a calibration factor for the trend factor are formed from these traffic data and their relationship with the current traffic parameters is established in a calibration arrangement, which is arranged between the traffic data processing and the fuzzy processing. The current speed density difference is divided by the speed density difference calibration factor and the respective current trend factor is divided by the trend calibration factor.

As already stated, the speed density difference is dependent on ambient conditions, such as wetness, fog, day/night etc. This fuzzy input variable is therefore assessed by the dynamic calibration factor. The value of this factor may apply as a threshold for the speed density difference, from which there is a high probability of the case of a critical traffic situation (disruption) existing. The calibration factor is calculated only if the speed density difference lies below a specific threshold, for example 0.3. The factor is made up of the mean value, the standard deviation from the speed density difference and its fixed threshold. The calculation of the mean value and of the standard deviation is carried out only on the basis of the relevant maxima of the speed density difference profile:

$$vk_Diff_{mittel} = \alpha \cdot vk_Diff + (1-\alpha) \cdot vk_Diff_{mittelalt}$$

$$\sigma_{vk_Diff} = \alpha \cdot (vk_Diff - vk_Diff_{mittel})^2 + (1-\alpha) \cdot \sigma_{vk_Diffalt}$$

$$vk_Diff_{mittelalt} = vk_Diff_{mittel}$$

$$\sigma_{vk_Diffalt} = \sigma_{vk_Diff}$$

The calibration factor is then calculated as follows:

$$KFT = \frac{\text{Characteristic}}{\text{Normalized instance "small" of the trend factor}}$$

The current trend factor is respectively divided by this calibration factor.

The method according to the invention of detecting critical traffic situations is used in a special development of the invention for detecting a disruption. In this case, bunching is detected in a bunching detection from the traffic parameters: trend factor and traffic intensity trend of the first measuring cross section, and a bunching probability variable is derived. In a preliminary disruption investigation, a disruption criterion is derived with the aid of the fuzzy decision from the traffic parameter of traffic intensity trend of the second measuring cross section and the bunching probability variable and, considered together with the trend factor and the speed density difference, makes detection of a disruption possible. Apart from the decision criteria of speed density difference and trend factor, the traffic parameters of traffic intensity trend at the measuring point MQ1 and at the measuring point MQ2, with which a preliminary investigation for a disruption is carried out, are used for the fuzzy disruption decision.

A bunching detection is carried out. Bunching is a group of vehicles of high traffic intensity and traffic density entering the measuring section.

The trend factor traffic parameter used for disruption detection allows two interpretation possibilities in cases of very great values. There is a disruption, ie. during quite a long period more vehicles have entered the measuring section than have left it, or a bunch has entered the measuring section. A bunch is to some extent a density wave, as occurs for example when a bottleneck is suddenly removed. To be able to distinguish reliably between these two cases, as stated above, bunching detection is carried out. The traffic intensity trend, the bunching probability in the preceding measuring interval, and the trend factor are used as the input variable of the fuzzy logic. Available directly as the output variable is a value for the probability of bunching in the measuring section being considered.

With the preliminary disruption investigation, the possibility of a disruption is concluded from the variables of traffic intensity trend, old disruption probability and bunching probability . The possibility of a disruption is represented by the disruption criterion output variable. If this value is high, the preliminary investigation indicates a disruption.

If, then, in addition the traffic intensity trend at the downstream measuring cross section decreases at a high value for a disruption criterion, the probability of a disruption is very high. With an increasing traffic intensity trend at the downstream measuring cross section, the possibility of a disruption drops, as it does in the case of an increase in the bunching probability. The case in which a disruption was very probable in the last measuring interval constitutes an exception. In this case, the disruption criterion is substantially independent of the bunching probability and the traffic intensity trend, since in the case of the disruption already detected in the last measuring interval both the bunching probability and the traffic intensity trend may further increase. The disruption detection is the decision stage which ultimately leads to the result of the probability of a disruption. In dependence on this variable, a warning is sent to the display cross section.

As already explained, the disruption probability is derived by means of a fuzzy control base from the variables: disruption criterion, trend factor and speed density difference. In the case of a very great positive speed density difference, a disruption very probably exists. The greater (positively) the speed density difference, the more probable a disruption. With a rising trend factor, if the speed density difference is positive, the probability of a disruption increases even more. If the disruption criterion is great, the trend factor has more influence. If the disruption criterion is smaller, ie. the characteristics do not indicate a disruption, the speed density difference alone decides, since it is in this case more reliable than the trend factor. In the result assessment, on the basis of the probability of a disruption, a display recommendation, for example jam warning, is derived for the variable message signs and the display is initiated.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

DESCRIPTION OF THE PREFERRED EMBODIMENTS

The road AS, shown here as a freeway with, for example, two lanes in one travelling direction, has two measuring cross sections MQi and MQ(i+1), which are arranged at a specific distance and form a measuring section MA. With the traffic sensors VS, for example vehicle detectors, which may be formed for example by double induction loops, traffic data VD are acquired and fed to a traffic data processing system VDA. The speed v, the traffic density K and the traffic intensity Q are acquired as traffic data and are further processed. In the traffic data processing system VDA, the traffic parameters: speed density difference vk–D, the trend factor FT and the traffic intensities QTi and QTi+1 are determined separately at the measuring cross sections MQi and MQi+t and are fed to a fuzzy logic for further processing. The fuzzy processing arrangement is denoted by FUB. The probability variable WG for a critical traffic situation which is formed there, as already explained above, is assessed in the result assessment arrangement EBE on the basis of a predeterminable threshold value SW in order to generate a control signal SG, for example as a display recommendation, for a variable message sign VWZ.

Figure 1:
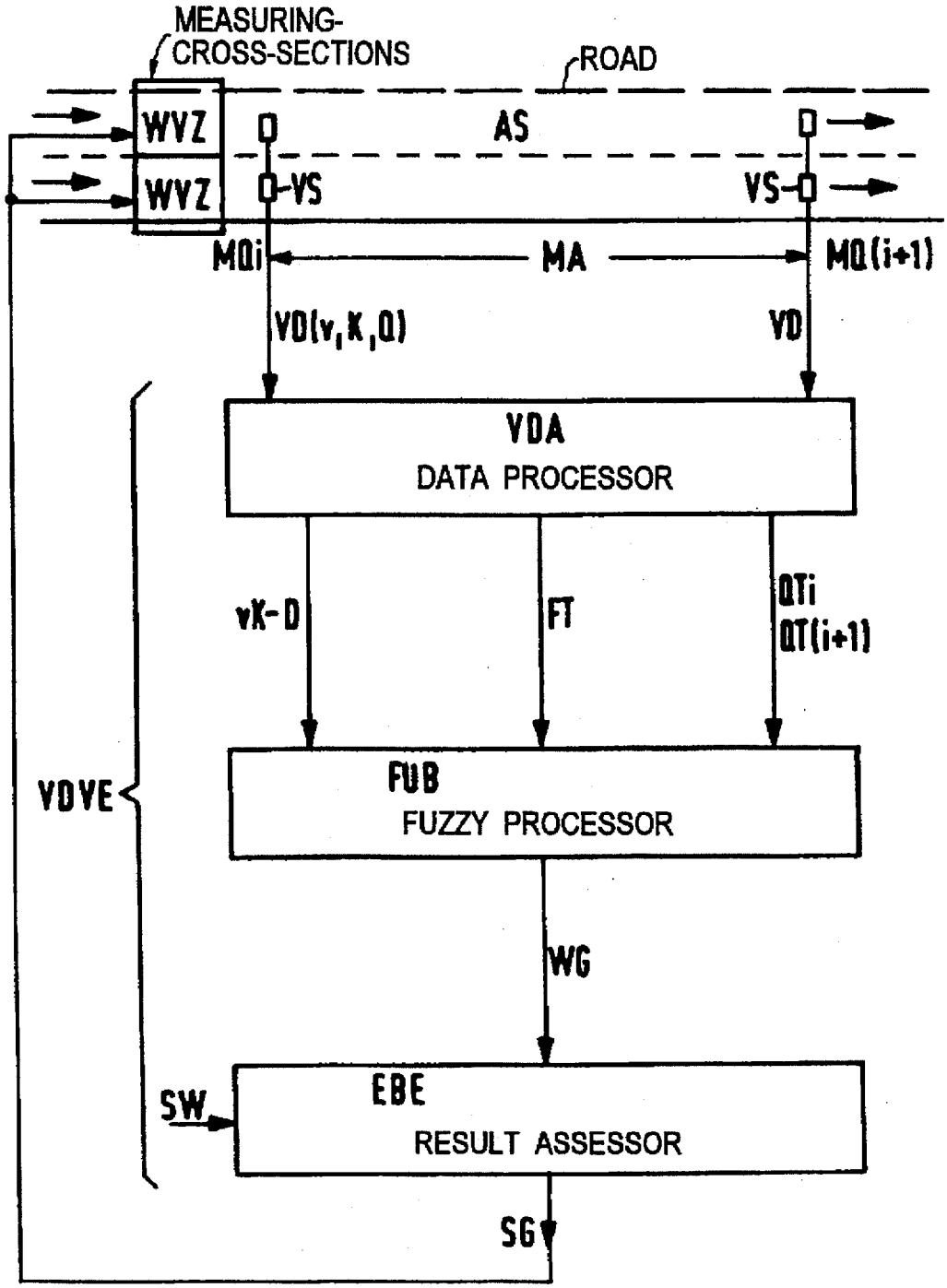
FIG. 1 shows a basic representation of the method according to the invention.
Figure 2:
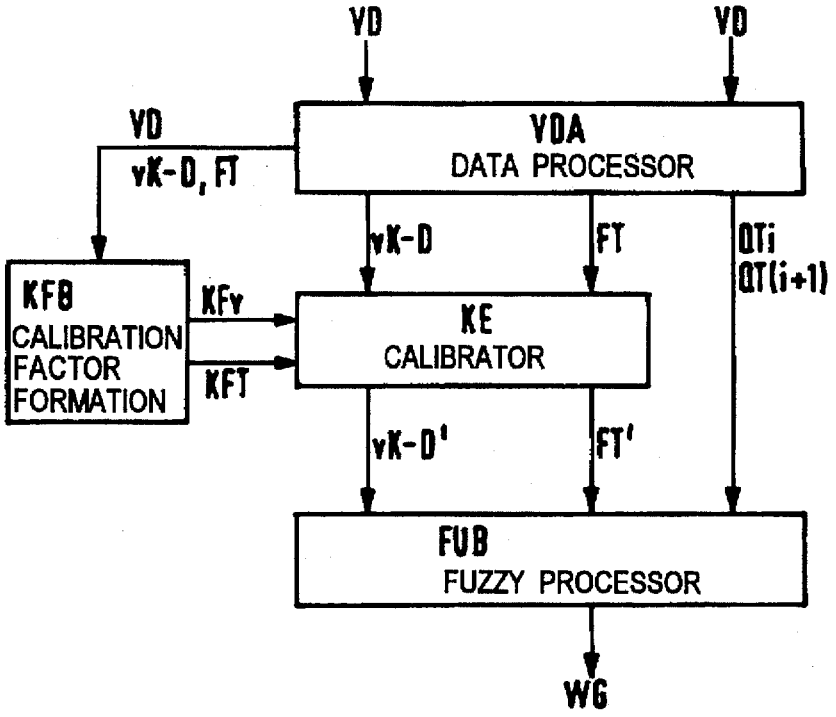
FIG. 2 shows a basic representation of a calibration.

In FIG. 2, the calibration already described above is schematically represented. In an arrangement for calibration factor formation KFB, the traffic data VD or traffic parameters vk–D and FT are used for forming a calibration factor for the speed density difference KFv and a calibration factor for the trend factor KFT. These factors are fed to the calibration arrangement KE, in which the traffic parameters of speed density difference and trend factor are consequently calibrated and fed as calibrated parameters vk–D; FT to the fuzzy processing FUB for the already explained further processing.

Figure 3:
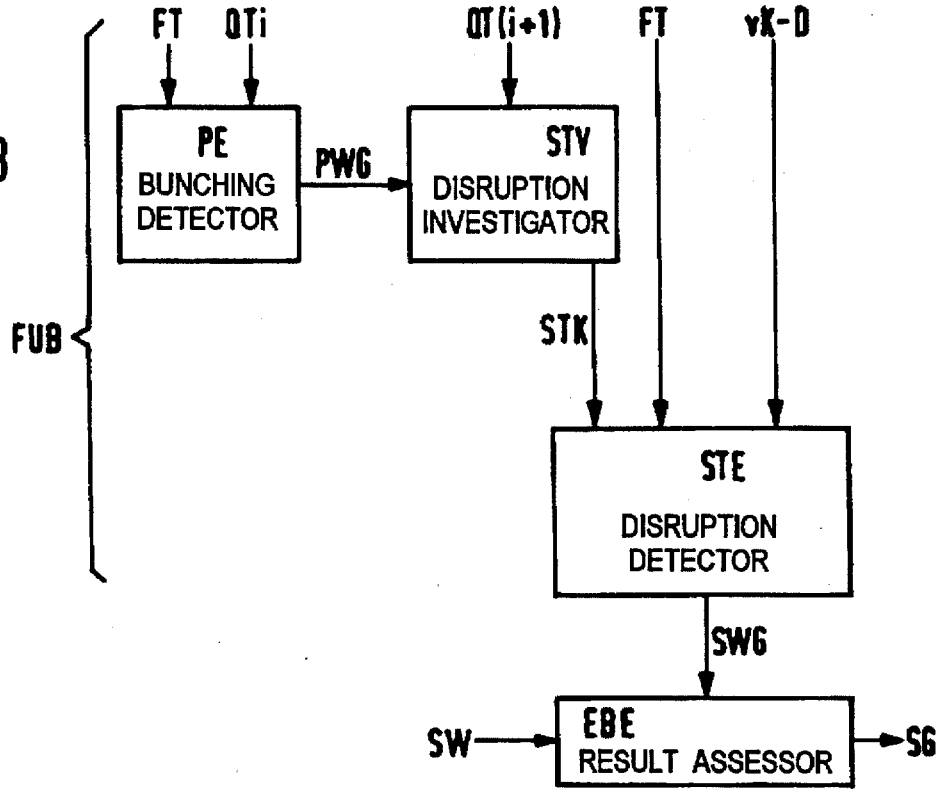
FIG. 3 shows a basic representation of a disruption detection.

In FIG. 3, the disruption detection is schematically represented. In the bunching detection PE, a bunching probability variable PWG is derived with the aid of the fuzzy logic from the input variables of trend factor FT and traffic intensity trend QTi at the measuring cross section MQi. This bunching probability variable PWG is considered in a preliminary disruption investigation STV with the traffic variable of traffic intensity trend QT(i+1) of the measuring cross section MQ(i+1) and a disruption criterion STK is derived from it. This criterion STK is considered together with the trend factor FT and the speed density difference vk–D in order to be able to conclude whether there is a disruption. This is indicated by the disruption detection STE. As explained above, in the disruption detection STE a disruption probability variable SWG is concluded and is treated further in a subsequent result assessment arrangement EBE.

The invention is not limited to the particular details of the method depicted and other modifications and applications are contemplated. Certain other changes may be made in the above described method without departing from the true spirit and scope of the invention herein involved. It is intended, therefore, that the subject matter in the above depiction shall be interpreted as illustrative and not in a limiting sense.

What is claimed is:

1. A method for sensing traffic and detecting traffic situations on roads having measuring points set up as measuring cross sections for vehicle detection using traffic sensors and a traffic data processing arrangement for traffic control, comprising the steps of:

determining at regular intervals traffic data, said traffic data have at least vehicle speed, traffic intensity, which is the number of vehicles at a measuring cross section based on a unit of time, and traffic density which is to say the number of vehicles based on a specific section of road, at the measuring points;

forming in a traffic data processing system traffic parameters determined from the traffic data and the traffic density, first and second adjacent measuring points furthermore forming a measuring section of a given length;

forming a speed density difference according to the following relationship:

$$vk-D=\sqrt{\left(\frac{v_{fi}-v_i}{v_{fi}}\right)^2+\left(\frac{k_i}{k_{max\,i}}\right)^2}-\sqrt{\left(\frac{v_{fi+i}-v_{i+1}}{v_{fi+1}}\right)^2+\left(\frac{k_{i+1}}{k_{max\,i+1}}\right)^2}$$

where vfi, vf(i+1) are adjustable maximum values of which speed at the first and second measuring points, respectively;

kmaxi, kmax(i+1) are adjustable maximum values of traffic density at the first and second measuring points, respectively;

ki is traffic density after the first measuring point;

k(i+1) is traffic density before the second measuring point;

vi, v(i+1) are average speeds at the first and second measuring points, respectively;

vk–D is the speed density difference;

the speed density difference, the trend factor and the traffic intensity trends being traffic parameters;

forming a trend factor continually from a ratio between traffic intensities of the first and second measuring points, but determined during a given time period in a minute range;

the forming a traffic intensity trend of a respective measuring point of the first and second measuring points, the trend being derived by a function of the traffic intensity over time from an increase of tangent to a curve of the function, traffic parameters with fuzzy logic for processing a direction of a critical traffic situation in the measuring section and feeding the traffic parameters as probability variables to a downstream result assessment arrangement, in which control signals for variable message signs are formed in dependence on adjustable threshold values.

2. The method as claimed in claim 1, wherein the traffic parameters of speed density difference and trend factor are dynamically calibrated in dependence on their past values, calibration factor for the speed density difference and a calibration factor for the trend factor being formed from the traffic data, and wherein in a calibration arrangement, arranged between the traffic data processing system and the fuzzy processing, a current speed density difference is divided by the speed density difference calibration factor and the current trend factor is divided by the trend factor calibration factor.

3. The method as claimed in claim 2, wherein, for calibration of the speed density difference, the speed density difference (latter) is assessed, a value of the calibration factor for the speed density difference being a threshold value for the speed density difference from which there is a high probability of a critical traffic situation.

4. The method as claimed in claim 2, wherein, for calibration of the trend factor, a characteristic value of the trend factor estimated to be "small" is defined such that characteristic value comprises a set of all values of the trend factor whose relative cumulative frequency lies below a threshold value, a frequency table being formed with a plurality of classes with defined ranges of values of the trend factor, and the current trend factor being assigned to a class in order to determine the calibration factor.

5. The method as claimed in claim 1, wherein a disruption is determined and displayed as a critical traffic situation, the trend factor and the traffic intensity trend of the first measuring point being used to detect bunching and to form a bunching probability variable, a relationship of which with the traffic intensity trend of the second measuring point is established in order to derive a disruption criterion, the trend factor and the speed density difference and the disruption criterion also being used to detect a disruption and to form a disruption probability variable.

* * * * *